US008573393B2

(12) United States Patent
Cole et al.

(10) Patent No.: US 8,573,393 B2
(45) Date of Patent: Nov. 5, 2013

(54) METHODS, APPARATUS, AND ASSEMBLIES ASSOCIATED WITH SPRING LOADED LEG CAP HINGES

(75) Inventors: Eric V. Cole, Phoenix, AZ (US); Douglas W. Anderson, Phoenix, AZ (US); Maximiliano A. Lopez, Phoenix, AZ (US); Greg J. Schmidt, Glendale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 1095 days.

(21) Appl. No.: 12/549,051

(22) Filed: Aug. 27, 2009

(65) Prior Publication Data

US 2011/0048986 A1 Mar. 3, 2011

(51) Int. Cl.
*A63B 55/00* (2006.01)

(52) U.S. Cl.
USPC ..... 206/315.7; 206/315.1; 206/315.2; 206/315.3; 248/96; 248/166; 248/168; 248/170; 224/613; 224/205; 224/257

(58) Field of Classification Search
USPC ..... 206/315.1, 315.2, 315.3, 315.7; 248/96, 248/166, 168, 170; 224/613, 205, 257
See application file for complete search history.

(56) References Cited

U.S. PATENT DOCUMENTS

| | | | | |
|---|---|---|---|---|
| 1,738,242 | A | 12/1929 | Gunther | |
| 1,887,838 | A | 11/1932 | Gunther | |
| 1,890,964 | A | 12/1932 | Zahorik | |
| 2,148,947 | A | 2/1939 | Jackson | |
| 2,199,055 | A | 4/1940 | Staugaitis | |
| 2,633,317 | A * | 3/1953 | Marsh | 248/96 |
| 4,645,152 | A * | 2/1987 | Downing | 248/96 |
| 5,082,218 | A | 1/1992 | Hoffman | |
| 5,096,148 | A | 3/1992 | Quellais | |
| 5,339,951 | A * | 8/1994 | Chen | 206/315.7 |
| 5,340,063 | A * | 8/1994 | Hsieh | 248/96 |
| 5,351,921 | A * | 10/1994 | Chen | 248/96 |
| 5,356,003 | A * | 10/1994 | Gretz et al. | 206/315.7 |
| 5,397,084 | A | 3/1995 | Wang | |
| 5,634,616 | A * | 6/1997 | Wang et al. | 248/96 |
| 5,662,296 | A * | 9/1997 | Wu | 248/96 |
| 5,799,786 | A * | 9/1998 | Beck et al. | 206/315.7 |
| 6,241,201 | B1 * | 6/2001 | Wang | 248/96 |
| 6,382,572 | B1 | 5/2002 | Lin | |
| 6,435,345 | B1 * | 8/2002 | Wang | 206/315.7 |
| 6,494,416 | B2 * | 12/2002 | Wang | 248/96 |
| 6,598,744 | B2 * | 7/2003 | Chen | 206/315.7 |

* cited by examiner

*Primary Examiner* — Anthony Stashick
*Assistant Examiner* — Cynthia Collado

(57) ABSTRACT

The examples provided describe a golf bag with a legged stand, and a golf bag collar assembly, each having a spring loaded leg cap hinge constructed to provide improved strength, reduced weight, strong holding force when the legs are closed, and a reduced retraction force when the legs are opened.

17 Claims, 9 Drawing Sheets

300

500

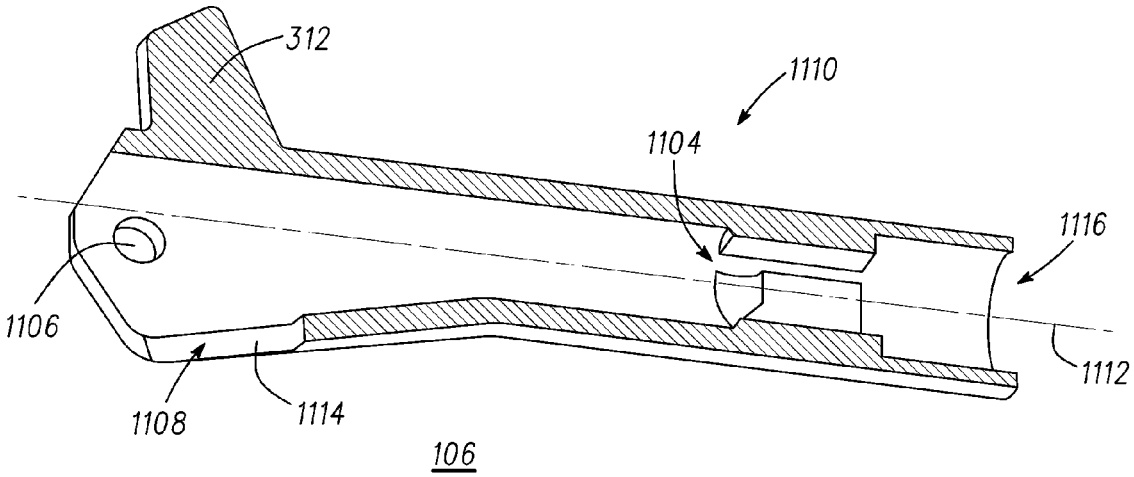
Fig. 11
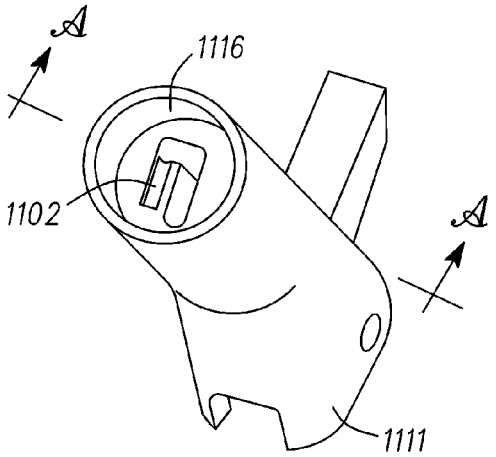

METHODS, APPARATUS, AND ASSEMBLIES ASSOCIATED WITH SPRING LOADED LEG CAP HINGES

TECHNICAL FIELD

The present disclosure relates generally to golf equipment, and more particularly, to methods, apparatus, and systems to assemble golf bags.

BACKGROUND

Industrial automation can provide many challenges in producing a product. Golf equipment is a particular challenge, and in particular golf bags. Golf bags have been around since golfers discovered that more than one club could be used to play the game, and that having something to carry the additional clubs in might be useful. However, since golf bags typically conform to the length of the clubs they are designed to hold, with the heavy end of the club extending out of the top of the bag, the bags can tend to be top heavy. Such a top heavy bag typically doesn't stand up very well on its own, so that the golfer can access his clubs. Also, if the course is wet the golfer may not want to lay his golf bag down on its side on the wet course. In the past hand carts, electric golf carts, and caddies may have been employed at one time or another to help a golfer manage with his clubs.

Hand carts are typically an add-on accessory that has wheels to aid in moving the bag and clubs about. Hand carts hold the clubs in a somewhat upright position for access to the clubs. Electric carts provide much the same function, but often may not be driven off of a path that is provided for them. Needless to say this does not allow easy access to ones clubs for shots landing far from the path, unless the player selects several possible clubs that he might like to use, and carries this reduced set to where his ball landed. Caddies provide the most flexibility as they are hired to mind the clubs so that the player's clubs are always conveniently available.

Some golfers simply prefer to carry their own clubs, because of budgetary constraints, the desire to get more exercise, or the like. When clubs are being carried it may be helpful to the golfer, or their caddy, to be able to stand the bag somewhat upright at times. A device provided to do this should be light and also allow for the bag to be carried easily. And finally, from a manufacturing standpoint such a device should be durable and easy to produce in a cost effective manner.

BRIEF DESCRIPTION OF THE DRAWINGS

The present description will be better understood from the following detailed description read in light of the accompanying drawings, wherein:

FIG. 11 shows further details of the hinge cap.

Like reference numerals are used to designate like parts in the accompanying drawings.

DESCRIPTION

The detailed description provided below, in connection with the appended drawings, is intended as a description of the present examples, and is not intended to represent the only forms in which the present example may be constructed or utilized. The description sets forth the functions of the example and the sequence of steps for constructing and operating the example. However, the same or equivalent functions and sequences may be accomplished by different examples.

The examples below describe a golf bag stand constructed with a special collar assembly having one or more spring loaded leg cap hinges to provide improved strength, functionality and reduced weight. Functionally, the spring loaded leg cap hinge used may allow support legs to be held securely against the bag during transport, and provide minimal resistance when the legs are extended. Such a spring loaded leg cap hinge may be utilized as an integral part of a golf bag assembly, a collar assembly used in golf bag construction, or a part of an add-on accessory (such as a removable stand, or cart).

In this document "spring loaded leg cap hinge" and the term "spring" are not meant to limit the examples to only those having springs. It is understood that these terms may refer to any device capable of producing a mechanical bias.

Although the present examples are described and illustrated herein as being implemented in a golf bag assembly, the system described is provided as an example and not a limitation. As those skilled in the art will appreciate, the present examples of spring loaded leg cap hinges are suitable for application in a variety of different types of systems utilizing a retractable hinge.

Figure 1:
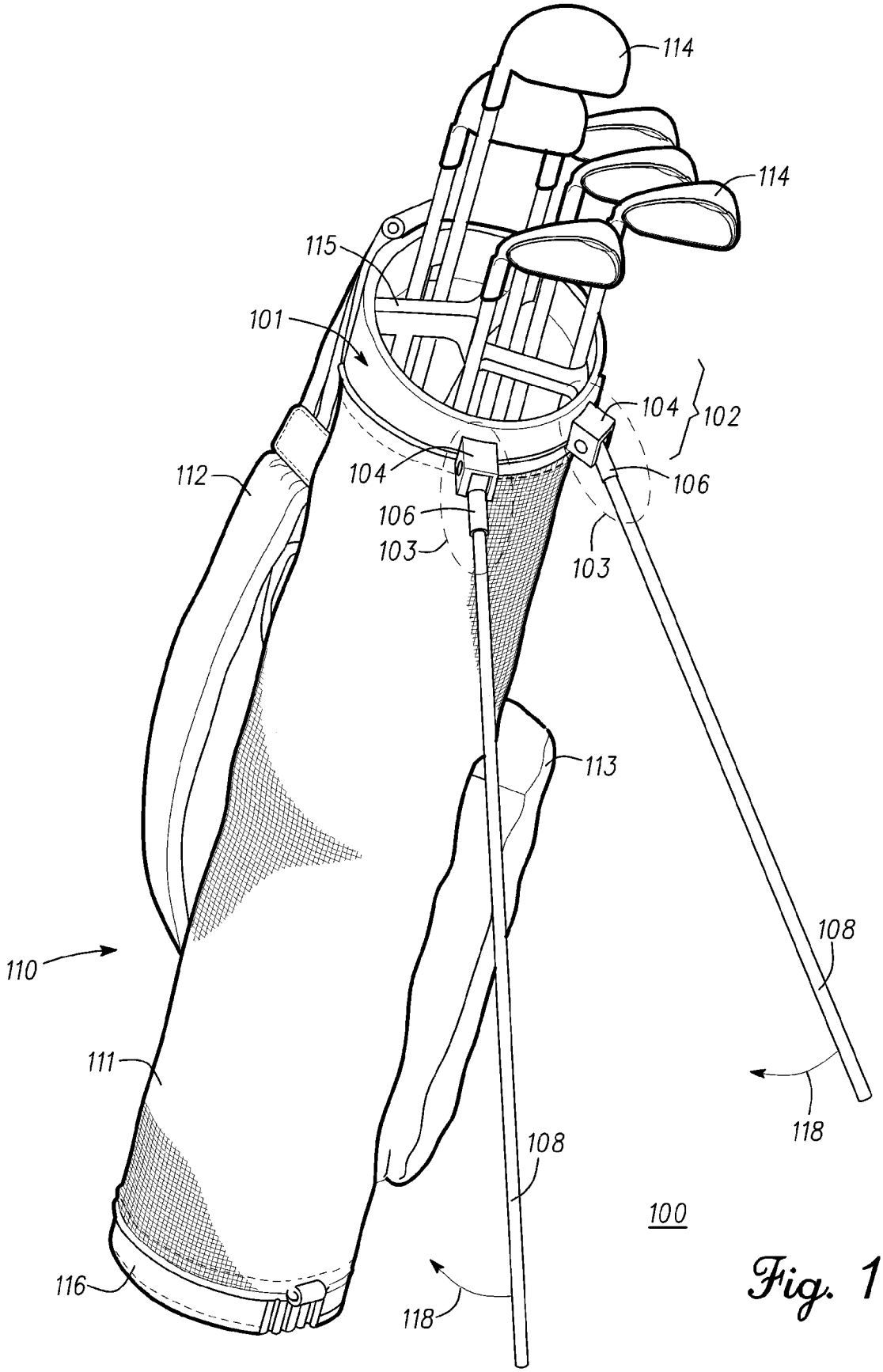
FIG. 1 shows an exemplary golf bag with an integral stand, having a collar assembly with spring loaded leg cap hinges, showing the legs of the stand in a deployed position.

FIG. 1 shows an exemplary golf bag 110 with an integral stand, having a collar assembly 102 with spring loaded leg cap hinges 103 showing the legs 108 in a deployed position 100. The golf bag 110 shown forms a tripod arrangement. The golf bag 110 may include two similar legs 108, which may form the three legs of the tripod arrangement with the golf bag 110, itself. Each of the two legs 108 and the golf bag 110 may be joined, at a collar assembly 102 having one or more spring loaded leg cap hinges 103.

The collar assembly 102 with one or more spring loaded leg cap hinges 103 may be provided to facilitate assembly of the golf bag 110, which has an integral stand. As a foundation, the collar assembly 102 may include a collar piece 101 (e.g., FIG. 4) that may be formed from plastic, and/or any suitable material(s). In one example, the collar assembly 102 includes one or more molded pieces. The collar assembly 102 may also include an internal set of dividers 115 to facilitate club 114 arrangement. The collar assembly 102 may be coupled to the bag body 111 by gluing, epoxying, riveting, and/or any suitable method(s).

In the examples described below the collar assembly 102 may include one or more spring loaded leg cap hinges 103. The spring loaded leg cap hinges 103 are disposed on the collar assembly 102 and typically include a pivot base 104, and a hinge cap 106, and additional components that will be described in further detail below.

The legs 108, may be constructed from any suitable material(s), such as fiberglass, aluminum, graphite composite, the like, or any combination thereof. The legs 108 may be coupled to the hinge cap 106. Coupling the legs 108 to the hinge cap 106 may be performed by any suitable method, such as gluing, riveting, threading into a mating receptacle, or the like. Alternatively, the legs 108 may be made as a single piece including the hinge cap 106.

The golf bag 110 may include a bottom piece 116 coupled to a rigid or semi-rigid bag body 111. The bag body 111 may be made of any suitable material(s) such as plastic, leather, nylon, the like or any combination thereof. The bottom piece 116 may be made from plastic, another equivalent material, and/or any other suitable material(s). The bottom piece 116 provides a firm surface for the clubs 114 to rest against, and also provides a wear resistant surface for setting the golf bag 110 on the ground. The bottom piece 116 may be formed as a well, a flat piece, or any suitable shape.

The golf bag 110 may also include a strap 112 coupled to it, and one or more accessory compartments 113. The strap 112 and compartment 113 may be made of any suitable material (s). The legs 108 may be disposed on the side of the golf bag 110 opposite from the strap 112, so that the legs 108 may be easily deployed when the golf bag 110 is set down.

When the legs 108 are not deployed, it may be desired to keep the legs 108, close to the bag body 111. To keep the legs 108 close, the spring loaded leg cap hinges 103 exert the maximum retention force when each of the legs 108 are closed against the bag body 111.

When the legs 108 are deployed, it may be desired that the legs 108 are maintained at a suitably far distance from the bag body 111 to form a stable tripod arrangement with a wide base. To keep the legs 108 deployed, the spring loaded leg cap hinges 103 may exert a minimum retention 118 force when the legs 108 are extended away from the body 111. The force is applied by the spring loaded leg cap hinges 103 and may be generated by the particular construction utilized in the spring loaded leg cap hinges 103. In addition, the spring loaded leg cap hinges 103 may be economically constructed and manufactured as the design is simple, elegant and low cost.

Figure 2:
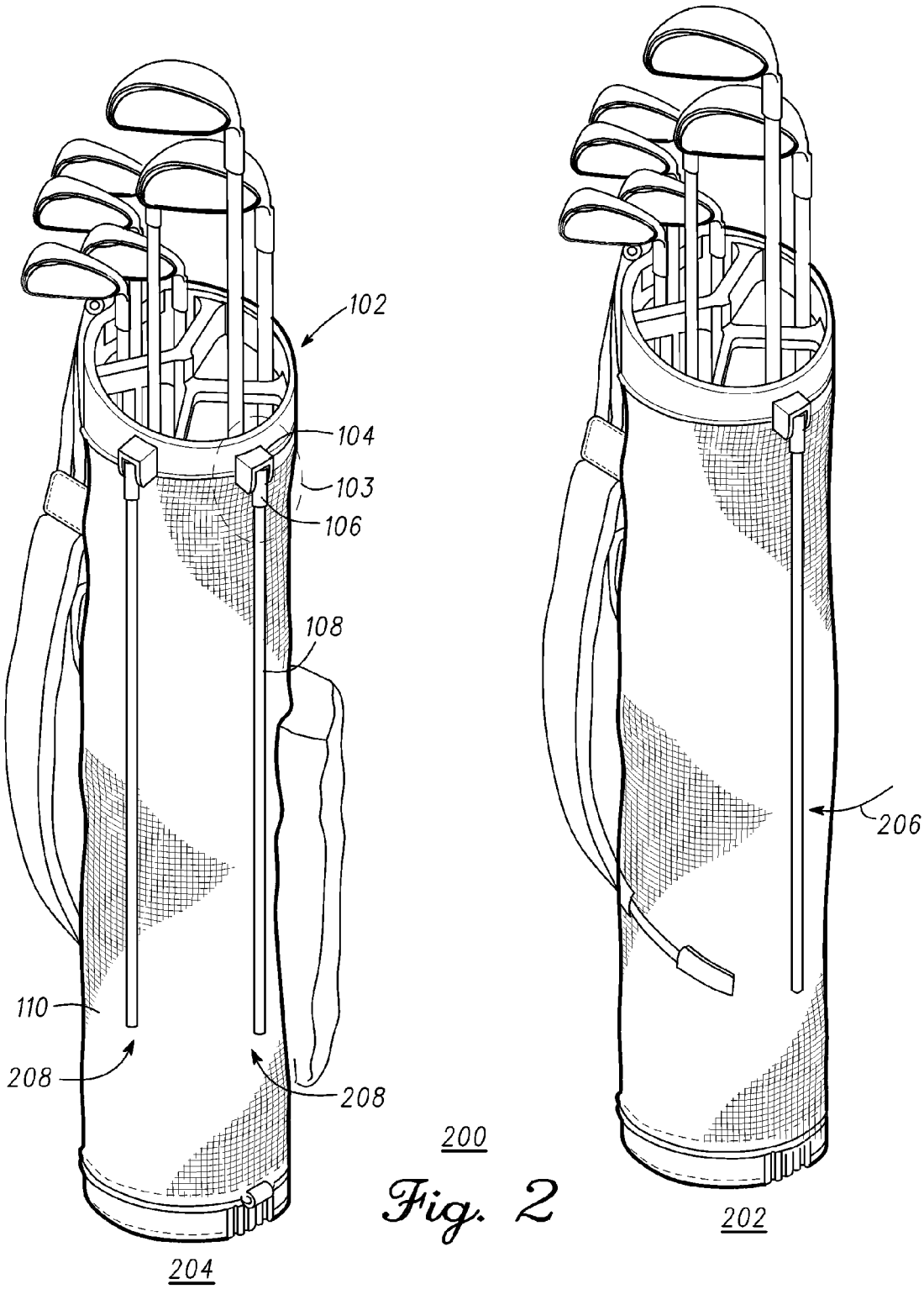
FIG. 2 shows the exemplary golf bag with integral stand, having a collar assembly with spring loaded leg cap hinges, showing the legs of the stand in a retracted position.

FIG. 2 shows a view 200 of the golf bag 110 with integral stand having a collar assembly 102 with spring loaded leg cap hinges 103 and the legs 208 in a retracted position. The golf bag 110 is shown from the side 202 and from the front 204. In the retracted position, the legs 208 are subject to a maximum retention force 206, which is exerted by one or more spring loaded leg cap hinges 103 that hold the legs 108 against the golf bag 110.

As shown, the legs 208 are held against the golf bag 110 in the retracted position. However, in alternative examples, the legs 208 may be held in grooves (not shown) provided in the golf bag 110. Such an alternative construction may be provided by extending channels from the collar assembly 102 along the length of the golf bag 110, or by providing a separate piece coupled to the golf bag 110. Such an extra piece, or channel, may provide extra strength, and shield the legs 208 from damage.

Figure 3:
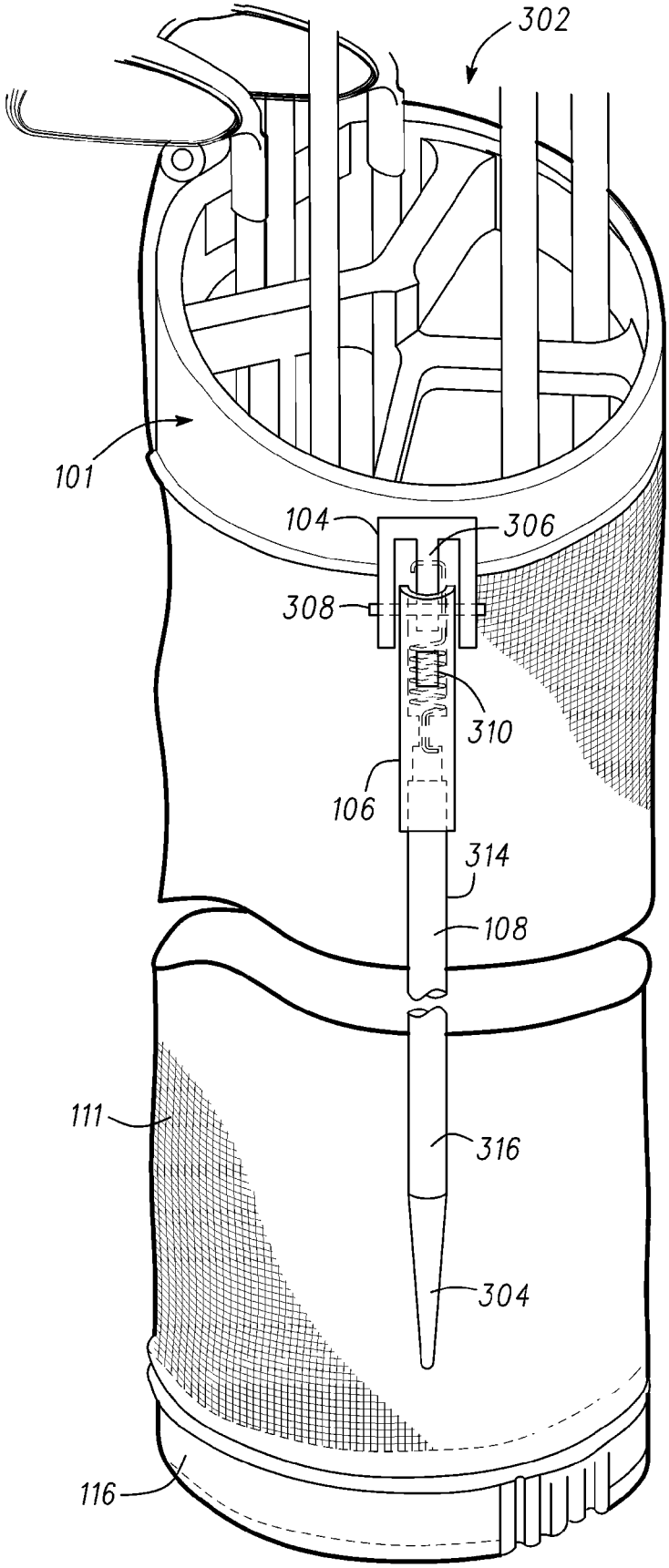
FIG. 3 shows an alternative example of a golf bag with an integral single leg stand (mono-pod bag), having a collar assembly with the spring loaded leg cap hinge, showing the legs of the stand in a retracted position.

FIG. 3 shows a golf bag with an integral single leg stand (mono-pod bag) 300, having a collar assembly 302 with the spring loaded leg cap hinge 103, and the leg 108 in a retracted position. The spring loaded leg cap hinge 103 includes, among other components, a boss 306, a pivot base 104, a hinge cap 106, and a bias device 310.

The spring loaded leg cap hinge 103 may be coupled to a first end 314 of a leg 108, constructed as previously described. A second end 316 of the leg 108 may be coupled to a spike 304. The spike 304 may be constructed of any suitable material, and may be used to support the mono-pod bag 300 by driving the spike 304 in the ground. The spike 304 may be made as an integral part of the leg 108 in a further alternative example. In yet another alternative example, a spring loaded leg cap hinge 103 may have a "Y" shaped hinge cap that may carry two legs 108 while only using one spring loaded leg cap hinge 103.

The mono-pod bag 300 may be used to save weight and reduce the number of legs 108 used to one leg. Though not as stable as a tripod, the mono-pod bag 300 may be of lighter weight, and may be easier to manufacture. The simple construction of the mono-pod bag 300, and in particular the lightweight construction of the spring loaded leg cap hinge 103, allows the leg 108 securely retained against the bag body 111 to swing out about a pivot point 308. The leg 108 is extended to in a position in which little or no retention force is exerted against the leg 108. When the leg 108 is taken in, a maximum force provided by the bias device 310 tends to keep the leg securely against the bag body 111.

The collar assembly 302 may be constructed as previously described, but with a single spring loaded leg cap hinge 103. The single spring loaded leg cap hinge 103 may be constructed as part of the collar assembly 302 according to any of the examples of collar assemblies described below for two legged bags (100 of FIG. 1).

Figure 4:
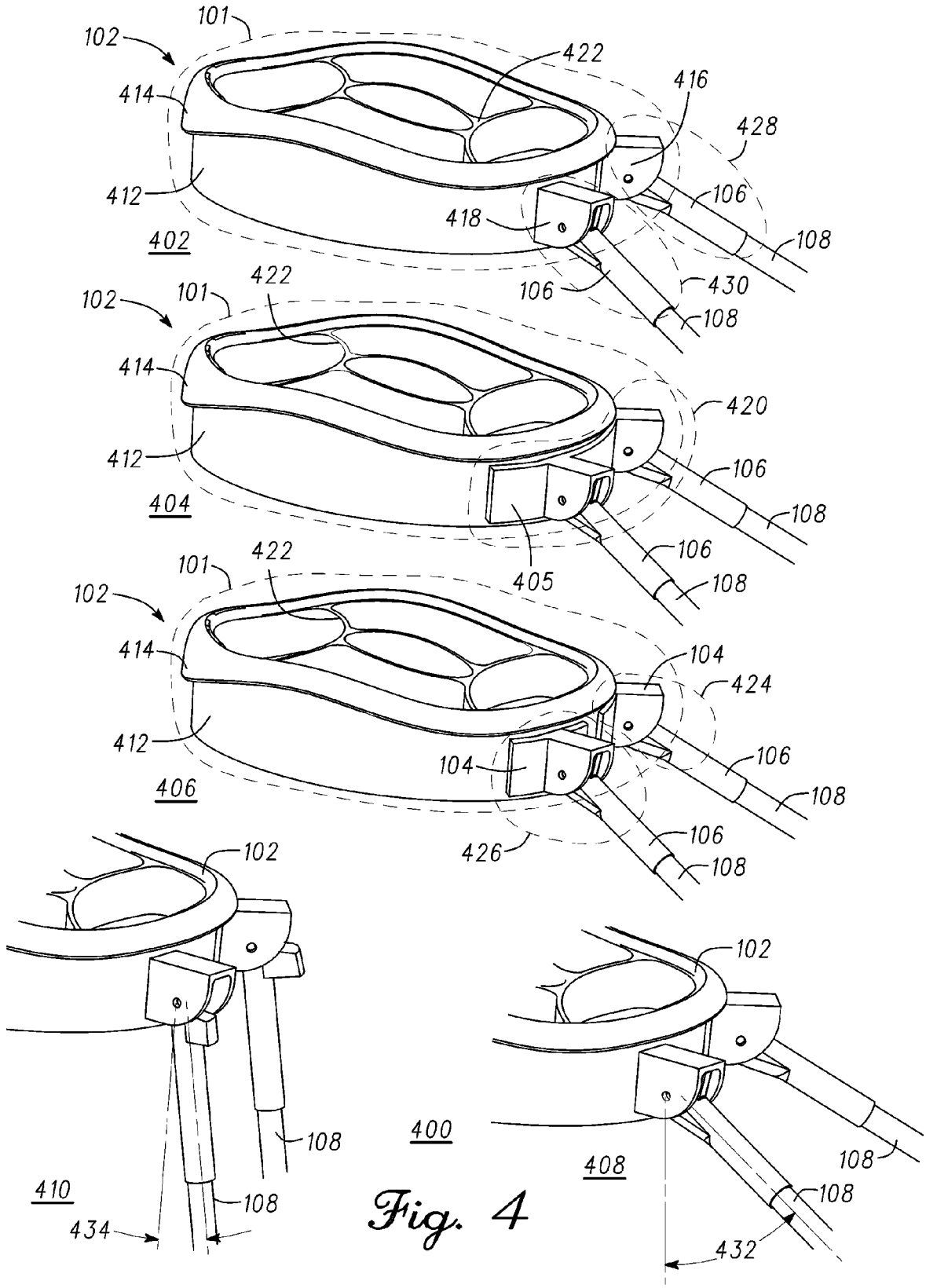
FIG. 4 shows various examples of collar assemblies including various forms of spring loaded leg cap hinges.

FIG. 4 shows various examples 400 of collar assemblies 402, 404, 406 including variations made in the spring loaded leg cap hinges (103 of FIG. 1). These examples 400 may include variations of the components that may allow easy assembly, and cost effective manufacturing of the previously generally described collar assembly (102 of FIG. 1). The examples shown include a first example of an integral collar assembly 402 including construction of spring loaded leg cap hinges 428, 430 formed from the collar piece 101, a second example of collar assembly 404 having spring loaded leg cap hinges (103 of FIG. 1) disposed in a pivot base subassembly 420, and a third example of a collar assembly 406 having a plurality of individual spring loaded leg cap hinges (103 of FIG. 1) coupled the collar 101.

The first example 402 of an integral collar construction of spring loaded leg cap hinges 428, 430 with one more pivot bases 416, 418 formed from the collar, utilizes the collar piece 101 as a base piece. This may be achieved by molding these parts 416, 418 into the collar piece 101. The collar assembly 402 may include a first integral spring loaded leg cap hinge 428 that includes a first integral pivot base 416 and a hinge cap 106 coupled to the leg 108. The collar assembly 402 may also include a second integral spring loaded leg cap hinge 430 that includes a second integral pivot base 418 and a hinge cap 106 coupled to a leg 108.

Dividers 422 may be disposed by molding or other methods into the collar piece 101. In alternative examples, the divider or dividers 422, may be omitted, or formed from a separate piece. Such a separate piece 422 may be screwed, glued, or attached by other equivalent methods to the collar piece 101. Alternatively, rods or bars may be disposed across the opening of the collar piece 101 to form dividers 422. The collar piece 101 may also include a lip 414 to provide a rounded edge providing a pleasant appearance and covering the edge of the body of the bag (111 of FIG. 1).

Alternatively, the lip 414 may be omitted and an edging piece (not shown) could be used to cover the junction of the body of the bag 111 against the collar piece 103. The first integral pivot base 416, and the second integral pivot base 418 may have hinge caps 106 and associated pieces described in detail below installed to complete this example of collar assembly 402.

The first example 402 of an integral collar construction of spring loaded leg cap hinges 428, 430 with one more pivot bases 416, 418 formed from the collar piece 101 can simplify manufacturing as the previously described pivot bases (104 of FIG. 1) may be included in the collar piece 111, which reduces the parts count and also eliminates any need for joining or fastening two pivot bases (104 of FIG. 1) to the collar piece 111.

In the second example 404, the dual pivot base sub assembly 420 can provide a wider more stable base 405 for attachment to a collar piece (e.g., the collar piece 101 of FIG. 1). Also a common base 405, may allow the relative position of the hinge caps 106 to be maintained so that with age and wear the legs 108 consistently open with a fixed position relative to each other. The dual pivot base subassembly 420 may be made from metal, plastic, any other suitable material(s), or any combination thereof. One or more hinge caps 106 and legs 108 may be coupled to the dual pivot base subassembly 420 as described further below. The dual pivot base subassembly 420 may in turn be coupled to the collar 103, to form the second example of collar assembly 404. The dividers 422, the lip 414, and the inner sleeve 412, may be constructed as described previously.

The second example of collar assembly 404 may simplify manufacturing by reducing parts count. The second example 404 uses a dual pivot base subassembly 420 also allows greater durability as the legs 108 may be maintained in a fixed relation to each other due to the pivot bases (104 of FIG. 1) of the pivot base subassembly 420 being made from common base 405.

The third example of a collar assembly 406 utilizes a plurality individual spring loaded leg cap hinges (103 of FIG. 1) coupled the collar piece 101. The collar piece 101 may be formed as described above to include dividers 422, a lip 414, an inner sleeve 412, and any other desired parts. A first spring loaded leg cap hinge 424 including a hinge cap 106, a pivot base 104, and additional components described below, is coupled to the collar piece 101. A second spring loaded leg cap hinge 426 including a hinge cap 106, a pivot base 104, and additional components as described below is also coupled to the collar piece 101 to form a collar assembly 406.

Views 408 and 410 shows the legs of the third example of the collar assembly 406, in extended position 432, and the retracted position 434, respectively. Components and internal construction of the spring loaded leg cap hinges (103 of FIG. 1) may allow each of the legs 108 to be held in a retracted position 434 with a sufficient amount of retaining force, and to be extended in a deployed position 432 such that the legs 108 are subject to a minimal amount of retaining force.

Figure 5:
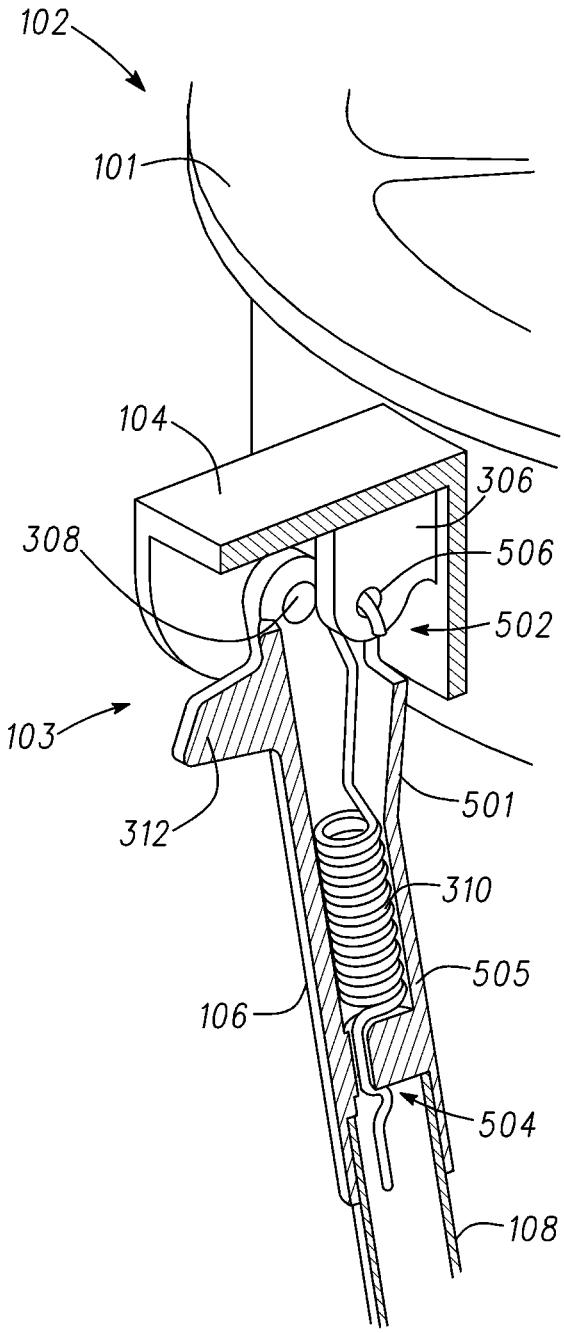
FIG. 5 shows a sectional view of an assembled spring loaded leg cap hinge.

FIG. 5 shows a sectional view 500 of the spring loaded leg cap hinge (103 of FIG. 1). Parts of the spring loaded leg cap hinge 103 may include a hinge cap 106, a pivot base 104, and a bias device 310. The pivot base 104 is coupled to a collar piece 101, as previously described. The pivot base 104 is also coupled to the hook end of the bias device 502, through a boss aperture 506 disposed in a boss 306. A first end 501 of the hinge cap 106 is pivotally coupled to the pivot base 104 at a pivot point 308 by using a conventional pin (not shown) or its equivalent. A second end 505 of the hinge cap 106 is coupled to a leg 108. The second end 505 of the hinge cap 106 may also be coupled to a straight end 504 of the bias device 310. The first end 501 of the hinge cap 106 may also include a travel limiting bump 312. The bias device 310 may be any structure capable of providing the mechanical bias. For example a spring, an elastic cord, a pneumatic strut, or the like.

The spring loaded leg cap hinge 103, when constructed as shown is provides a minimal force when the leg 108 is opened and a maximum force when the leg 108 is closed. The following figures illustrate the interaction of the components shown in sectional view 500 as the leg 108 will be moved from a closed position to an open position.

Figure 6:
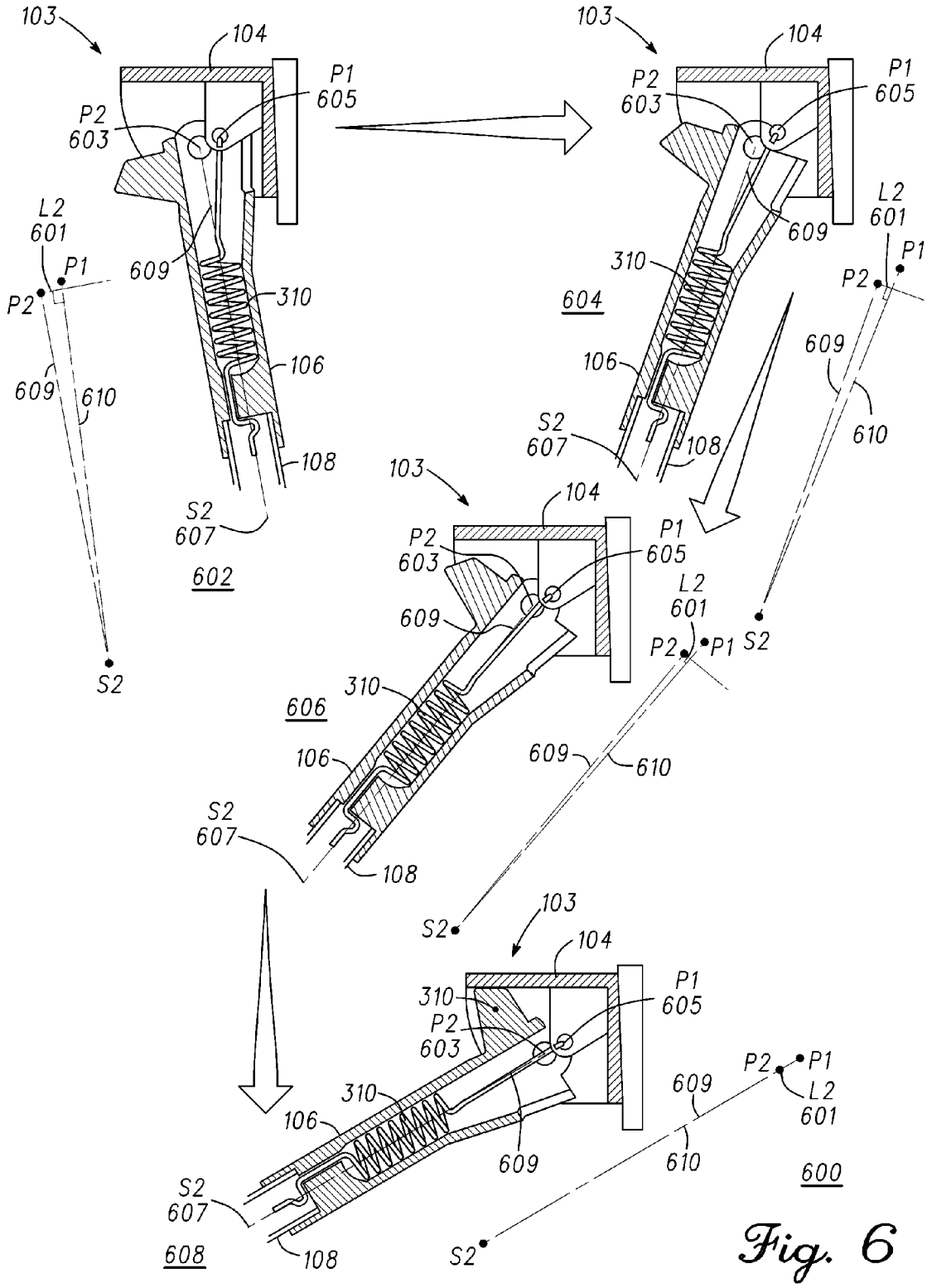
FIG. 6 is a series of exemplary diagrams of spring loaded leg cap hinges showing the leg in various positions from a fully retracted position to a fully deployed position.

FIG. 6 is a series of exemplary diagrams 600 of spring loaded leg cap hinge 103 showing the leg 108 in various positions from fully closed 602 to fully opened 608. The leg 108 is shown in a retracted position 602, starting to extend 604, approaching full extension 606, and fully extended 608. The series of views 602, 604, 606, 608, also shows the cooperation of components 104, 310, 106, 108 in a spring loaded leg cap hinge 103.

As will be appreciated by those skilled in the art the retention force (or equivalently "torque") that may be exerted on the leg 108 at its pivot point 603 is directly proportional to the variable distance (L2) 601 from the leg pivot point (P2) 603 to the line formed by a long axis of the bias device 610. Thus, due to the unique construction, when the leg 108 is fully extended 608, an end of the bias device 310 that is coupled to the attachment point (P1) 605 comes close to, or may touch a pivot pin (not shown). The pivot pin may be disposed at point P2 603, so the distance 601 and thus the force is minimal. In the closed position 602, the distance 601 is greatest, and thus the greatest retention force is provided.

In view 604, the leg 108 is starting to extend. As the leg 108 extends, lines 609 and 610 begin to coincide as distance L2 601 is reduced. In view 606, the leg 108 is approaching full extension. With further extension of the leg 108, distance L2 601 continues to be reduced.

In view 608, the leg 108 is fully extended, as the travel limiting bump 310 has contacted the pivot base 104. Distance L2 601 has been reduced to its minimum, which could be zero, and the force on the leg 108 is at a minimum. As a result of points P1 605 and P2 603 being close together, the length of the bias device 310 coupled from the spring attachment point on the leg (S2) 607 may not change significantly. As will be explained next, the larger change in distance L2 601 contributes most to the force generated (without wearing the spring through stretching) than the spring force.

Figure 7:
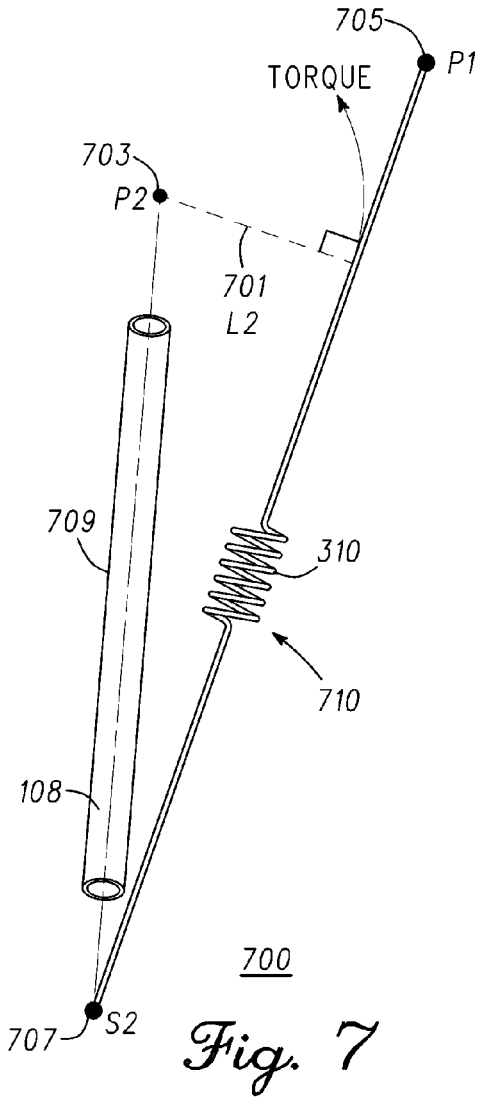
FIG. 7 shows how a maximum closing force can be applied when the leg is closed, and how a minimal closing force can be applied when opened.

FIG. 7 shows how a maximum closing force may be applied when the leg (108 of FIG. 1) is closed, and the closing force may be minimal when the leg (108 of FIG. 1) opened. This may be achieved without undue flexing, or elongations of the bias device 310. It may also change the rate at which bias device 310 force increases or decreases as the leg (108 of FIG. 1) is moved.

The bias device 310 is coupled from point labeled P1 705 on the pivot base (104 of FIG. 1) to an attachment point on the long axis of the leg (108 of FIG. 1) labeled 52 707. The leg (108 of FIG. 1) pivots about point labeled P2 703. As the leg (108 of FIG. 1) pivots, the length of the bias device 310 disposed between points P1 705 and S2 707 will change. The spring tension force exerted by the bias device 310 between these points 705, 707 changes and is based on Hooke's law, $F=kx$, where k is the spring constant and x is the distance from P1 705 to S2 707.

The spring force between points P1 705 and S2 707 applies a torque to the line defined by points S2 707 and P2 703. The net torque applied to the leg (108 of FIG. 1) may be summarized by:

$$\text{Net Torque}=F\times L2 \quad (1)$$

In which L2 701 is the line segment from point P2 extended to a perpendicular (normal) intersection of line defined by points P1 705 and S2 707.

Accordingly, the torque applied to the leg (108 of FIG. 1) is dependent on the spring length from points labeled P1 705 to S2 707 and line segment L2 701 length.

However, the distance between points P1 705 to P2 703 is relatively small in comparison the distance between points P1 705 to S2 707, and change in length between points P1 705 to S2 707 as the leg (108 of FIG. 1) rotates, is minimal. Therefore, the force applied by the bias device 310 is approximately a constant value, and which according to equation (1) means that the net torque applied to the leg (108 of FIG. 1) is dependent on the length of line segment L2 701.

Figure 8:
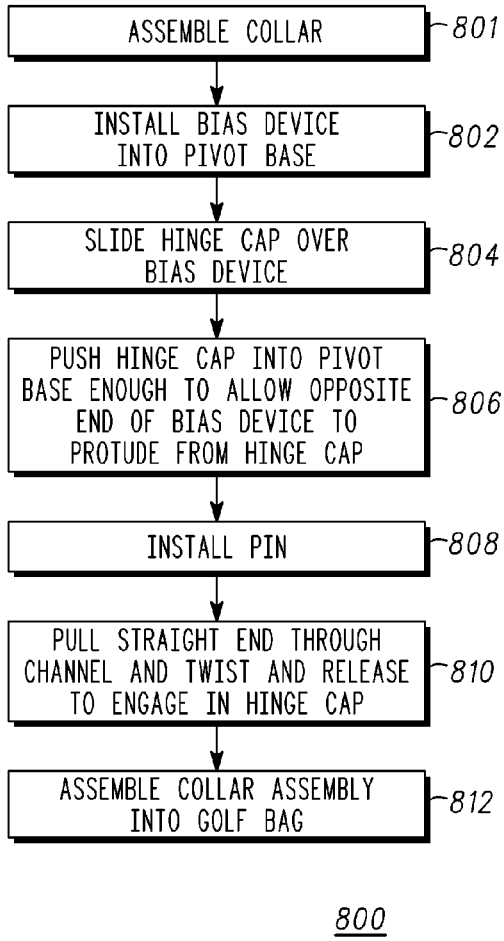
FIG. 8 shows a process for assembling the spring loaded leg cap hinge.

FIG. 8 shows the process 800 for constructing a spring loaded leg cap hinge (103 of FIG. 1). First the collar assembly (102 of FIG. 1) is put together (block 801). The bias device is installed in into a pivot base (block 802). Next the hinge cap is slid over the bias device (block 804). At block 806, the hinge cap is pushed into the pivot base far enough to allow the opposite end of the bias device to protrude from the hinge cap. At block 808, the pin is installed to provide a pivot point for the hinge. At block 810, a straight end of the bias device is pulled through the channel in the hinge cap and twisted and released to engage the bias device into a depression in the hinge cap.

Figure 9:
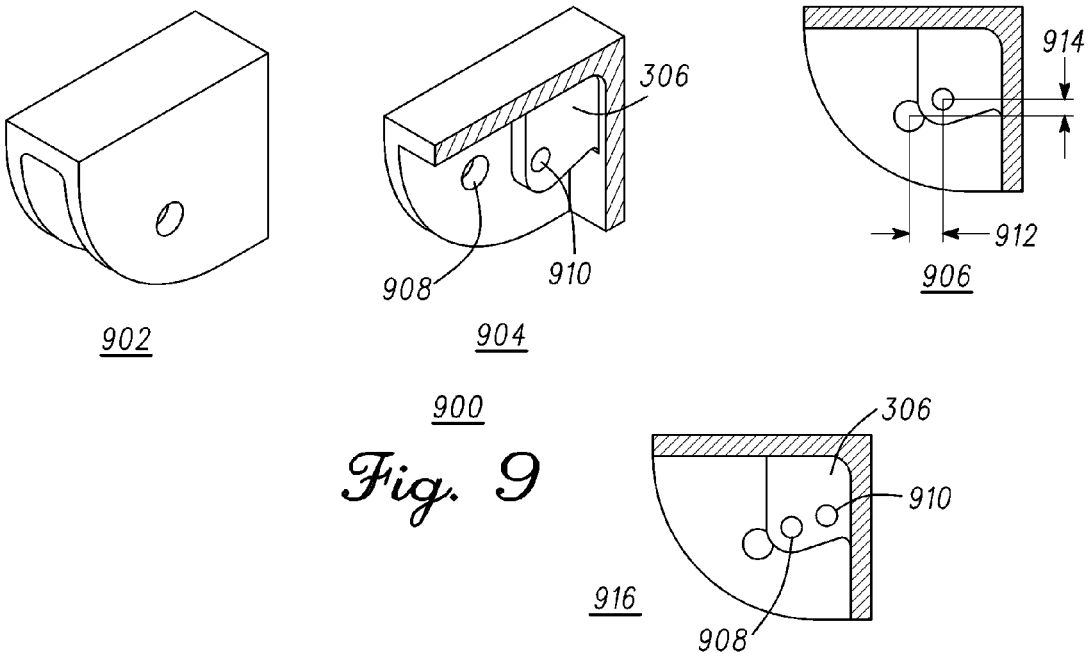
FIG. 9 is a diagram showing further details of the pivot base.

FIG. 9 is a diagram 900 showing further details of the pivot base (104 of FIG. 1). The views 902, 904, and 906 show details of a first exemplary pivot base (104 of FIG. 1). View 916 shows a sectional view of an alternative example of the pivot base (104 of FIG. 1), in which the boss 306 includes the pivot aperture 908 and a boss aperture 910. This completes the collar assembly (102 of FIG. 1). Referring back to FIG. 8, at block 812, the collar assembly (102 of FIG. 1) is assembled into the golf bag (110 of FIG. 1).

View 902 is a perspective view showing the exterior, of the hinge cap (106 of FIG. 1), which may be made of any suitable material(s) such as plastic, nylon, metal, the like, or any combination thereof. View 904 shows the interior of the hinge cap 106 with the boss 306 having a boss aperture 910 and a pivot aperture 908. View 906 shows the relationship of the horizontal pivot to a boss aperture offset 912 and the vertical pivot to a boss aperture offset 914.

Figure 10:
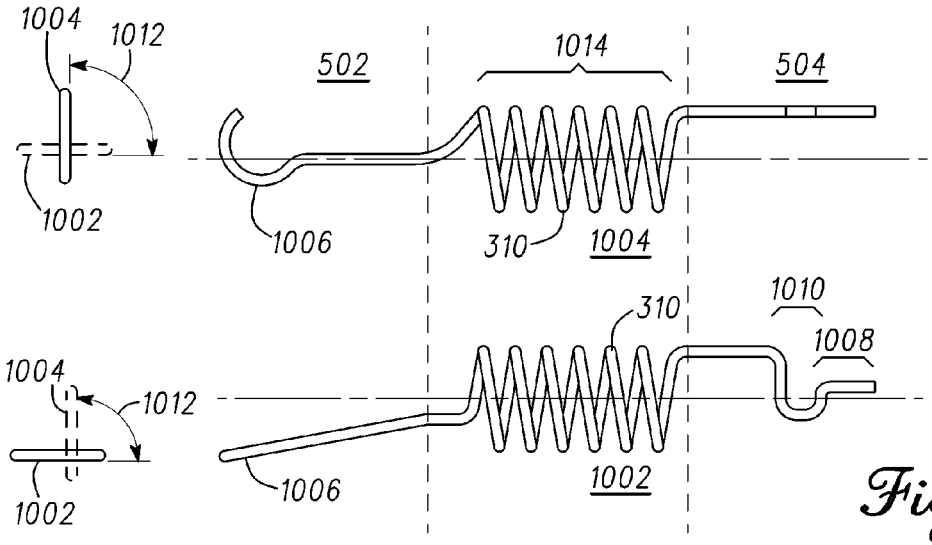
FIG. 10 shows further details of the bias device.

FIG. 10 shows two side views 1002, 1004 of the bias device 310 that are rotated ninety degrees 1012 from each other so that the details of the hook end 502 may be seen, and the details of the straight end 504 may be seen. The bias section 1014 is shown as a mechanical spring. However, in alternative examples as previously noted other devices capable of producing a mechanical bias may be used. At the hook end 502 of the bias device 310, a hook 1006 or equivalent shape may be provided to sufficiently couple to the boss aperture (910 of FIG. 9) of the hinge cap (106 of FIG. 1). At the opposite end of the bias device 310, the straight end 504 includes a flat portion 1010 to seat into a suitable depression in the hinge cap (106 of FIG. 1) and past the flat section 1010, is a gripping section 1008 to allow the bias device 310 to be installed into the hinge cap (106 of FIG. 1) by gripping it and pulling it through the hinge cap (106 of FIG. 1). Flat section 1010 may be formed with a transition into gripping section 1008 by placing a kink, or other suitable bend into the straight end 504. Although the ends 502, 504, are oriented ninety degrees 1012 from each other, other equivalent orientations may also be utilized.

FIG. 11 shows further details of the hinge cap. Shown is a sectional view 1110 along the longitudinal axis 1112 of the hinge cap 106. FIG. 11 also depicts an end view 1111 of the hinge cap 106. The hinge cap 106 may be made of any suitable material including metal, plastic, any other suitable material(s), or any combination thereof. The hinge cap 106 includes a travel limiting bump 312, and a relieved section 1108 to allow for free movement of the bias device (310 of FIG. 3) when in use. The relieved section 1108 also includes a notch 1114 for clearance of the boss (306 of FIG. 3) during operation. An aperture 1104 may be provided to allow passage of the bias device straight end (504 of FIG. 5) and for anchoring it within a well 1102. An opening 1116 accepts a leg (108 of FIG. 1). An end view of well 1102, and opening 1116 are provided in view 1111. When the straight end of the bias devices is passed through aperture 1104, well 1104 may capture a kink at a juncture of a gripping section (1008 of FIG. 10) and a flat section (1010 of FIG. 10) in the bias device (310 of FIG. 3) holding the bias device (310 of FIG. 3) in place. The well 1102 allows an assembler to have access to the bias device so that it may be installed into the hinge cap 106, After the hinge is assembled the leg (108 of FIG. 1) may be disposed into the well 1102.

Although one or more figures may depict a golf bag (e.g., a carry bag), the methods, apparatus, and articles of manufacture described herein may be readily applicable to other suitable types of bags. The apparatus, methods, and articles of manufacture are not limited in this regard.

Although certain example methods, apparatus, and/or articles of manufacture have been described herein, the scope of coverage of this disclosure is not limited thereto. On the contrary, this disclosure covers all methods, apparatus, and/or articles of manufacture fairly falling within the scope of the appended claims either literally or under the doctrine of equivalents.

What is claimed is:

1. A golf bag with an integral stand comprising:

a bag body having an opening into which one or more golf clubs may be disposed;

a leg; and a collar assembly associated with the opening, the collar assembly including a spring loaded leg cap hinge coupled to the leg, and the collar assembly coupled to the bag in which the collar assembly further comprises: a collar piece; a pivot base coupled to the collar piece; a hinge cap coupled to the pivot base and leg; and a bias device coupled between the pivot base and the hinge cap, the bias device exerts a holding force to maintain the leg against the bag when the leg is not deployed, and the bias device does not exert the holding force when the leg is deployed in which the bias device includes a first end coupled to a boss disposed in the pivot base, in which the bias device includes a second end formed for coupling to the hinge cap by resting in a groove disposed in the hinge cap, in which the bias device includes a second end formed for coupling to the hinge cap by resting in a groove disposed in the hinge cap.

2. The assembly of claim 1 in which pivotal coupling is by a press fit pin.

3. The assembly of claim 1 in which the pivot base is formed into the collar piece.

4. The assembly of claim 1 in which the pivot base is pivotally coupled to the hinge cap.

5. The assembly of claim 1 in which the bias device includes a long axis and the holding force is predominately generated by a distance from the long axis to a point of coupling of the hinge cap and the pivot base.

6. The assembly of claim 1 in which the bias device is coupled to a boss in the hinge cap.

7. The assembly of claim 1 in which the bias device includes a first end disposed on an orthogonal orientation to a second end.

8. The assembly of claim 1 in which the bias device comprises at least one of a spring, an elastic cord, or a pneumatic strut.

9. An assembly method comprising:

installing a first end of a bias device in a pivot base in which the pivot base includes a boss for installing the first end of the bias device;

sliding a hinge cap over a second end of the bias device in which the second end of the bias device is formed for coupling to the hinge cap by resting in a groove disposed in the hinge cap;

aligning a kink in the second end of the spring with an aperture disposed in the hinge cap;

pulling the second end of the bias device through the aperture disposed in the hinge cap;

pivotally coupling the hinge cap to the pivot base; and engaging the groove formed by the second end of the bias device with the hinge cap.

10. The method of claim 9 further comprising assembling a collar.

11. The method of claim 10 further comprising coupling the collar assembly to a golf bag.

12. An assembly comprising:

a collar piece associated with a collar in an assembled golf bag having an integral stand;

a pivot base coupled to the collar piece; a hinge cap pivotally coupled to the pivot base; and a bias device coupled to the hinge cap and the pivot base in which the bias device includes a first end coupled to a boss disposed in the pivot base in which the bias device includes a second end formed for coupling to the hinge cap by resting in a groove disposed in the hinge cap.

13. The assembly of claim 12, in which the pivot base is formed as part of the collar piece.

14. The assembly of claim 12, in which the bias device is a pneumatic strut.

15. The assembly of claim 12, in which the bias device is an elastic cord.

16. The assembly of claim 12, in which the bias device is a spring.

17. The assembly of claim 12, in which the bias device provides a mechanical bias.

* * * * *